US009347327B2

(12) United States Patent
Armstrong et al.

(10) Patent No.: US 9,347,327 B2
(45) Date of Patent: May 24, 2016

(54) F-CLASS GAS TURBINE COMPRESSOR EXIT GUIDE VANE REPAIR

(71) Applicant: Dresser-Rand Company, Olean, NY (US)

(72) Inventors: Justin C. Armstrong, Willis, TX (US); Graham D. Sherlock, Houston, TX (US); Greg T. Snyder, Conroe, TX (US); David L. Bollinger, Spring, TX (US); Paul V. Sickles, Verona, KY (US); David L. Sanchez, Katy, TX (US); Dillon R. Jourde, Fort Worth, TX (US)

(73) Assignee: Dresser-Rand Company, Olean, NY (US)

( * ) Notice: Subject to any disclaimer, the term of this patent is extended or adjusted under 35 U.S.C. 154(b) by 405 days.

(21) Appl. No.: 13/898,655

(22) Filed: May 21, 2013

(65) Prior Publication Data

US 2013/0336794 A1 Dec. 19, 2013

Related U.S. Application Data

(60) Provisional application No. 61/659,926, filed on Jun. 14, 2012.

(51) Int. Cl.
*F01D 5/00* (2006.01)
*F01D 9/00* (2006.01)

(52) U.S. Cl.
CPC *F01D 9/00* (2013.01); *F01D 5/005* (2013.01); *F05D 2230/90* (2013.01); *Y10T 29/49318* (2015.01)

(58) Field of Classification Search
CPC ..... F01D 9/00; F01D 5/005; F01D 25/243; F01D 25/28; F01D 25/246; Y10T 29/49318; F05D 2230/90
USPC ..... 415/209.2, 209.3
See application file for complete search history.

(56) References Cited

U.S. PATENT DOCUMENTS 5,328,327 A * 7/1994 Naudet ..... F01D 17/162 29/889.22

* cited by examiner

*Primary Examiner* — Igor Kershteyn
*Assistant Examiner* — Aaron R Eastman

(57) ABSTRACT

A system and method for repairing a turbine. The method includes applying a coating on an outer surface of a tenon that extends from a stator vane. The tenon may be inserted at least partially into an opening defined by an inner shroud segment of the turbine. A bushing may be inserted at least partially into the opening in the inner shroud segment of the turbine such that the tenon becomes at least partially disposed within an opening defined by the bushing. A bolt may be inserted through the opening in the bushing and at least partially into an opening defined by the tenon. The bolt may be threadably engaged with the tenon.

17 Claims, 7 Drawing Sheets

F-CLASS GAS TURBINE COMPRESSOR EXIT GUIDE VANE REPAIR

CROSS-REFERENCE TO RELATED APPLICATIONS

The present application claims priority to U.S. Provisional Patent Application Ser. No. 61/659,926, which was filed Jun. 14, 2012. This priority application is hereby incorporated by reference in its entirety into the present application, to the extent that it is not inconsistent with the present application.

BACKGROUND

Generally, a gas turbine includes an upstream compressor coupled to a downstream turbine, and a combustion chamber is disposed therebetween. One commercial gas turbine is the GE 7FA+e (also known as 7FA.03 and 7241) manufactured by the General Electric Company of Schenectady, N.Y. As designed and commercially produced, the GE 7FA+e is a multistage gas turbine utilizing compressor vane assemblies in the latter stages. Multiple flaws have been found to exist in the design and manufacturing process of these multi-stage gas turbines, particularly in the stage seventeen compressor vane assembly. Although General Electric has provided a modified design to correct one of the aforementioned flaws, such design typically includes replacement of the entire compressor vane assembly. Accordingly, there is a need to develop a simple, inexpensive, and efficient method to modify the compressor vane assembly having the inherent flaws, or to repair the originally-designed GE multistage turbines in service having the aforementioned flaws.

SUMMARY

A method for repairing a turbine is disclosed. The method includes applying a coating on an outer surface of a tenon that extends from a stator vane. The tenon may be inserted at least partially into an opening defined by an inner shroud segment of the turbine. A bushing may be inserted at least partially into the opening in the inner shroud segment of the turbine such that the tenon becomes at least partially disposed within an opening defined by the bushing. A bolt may be inserted through the opening in the bushing and at least partially into an opening defined by the tenon. The bolt may be threadably engaged with the tenon.

In another embodiment, a coating is applied on a curved outer side surface of a tenon extending from a stator vane. The coating may include aluminum and have a thickness from about 0.001" (0.025 mm) to about 0.020" (0.51 mm). The tenon may be inserted at least partially into an opening defined by an inner shroud segment of the turbine. A bushing may be inserted at least partially into the opening in the inner shroud segment of the turbine such that the tenon becomes at least partially disposed within an opening defined by the bushing. The coating may form an interference fit between the tenon and the bushing. A bolt may be inserted through the opening in the bushing and at least partially into an opening defined by the tenon. The bolt may be threadably engaged with the tenon.

A repaired portion of a turbine is also disclosed. The repaired portion of the turbine may include an inner shroud segment defining an opening extending therethrough. A stator vane may have a tenon extending therefrom, and the tenon may be at least partially disposed within the opening in the inner shroud segment. A coating may be disposed on an outer surface of the tenon. A bushing may be at least partially disposed within the opening in the inner shroud segment. The tenon may be at least partially disposed within an opening defined by the bushing. A bolt may be at least partially disposed within the opening in the bushing and threadably engaged with an inner surface of the tenon.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
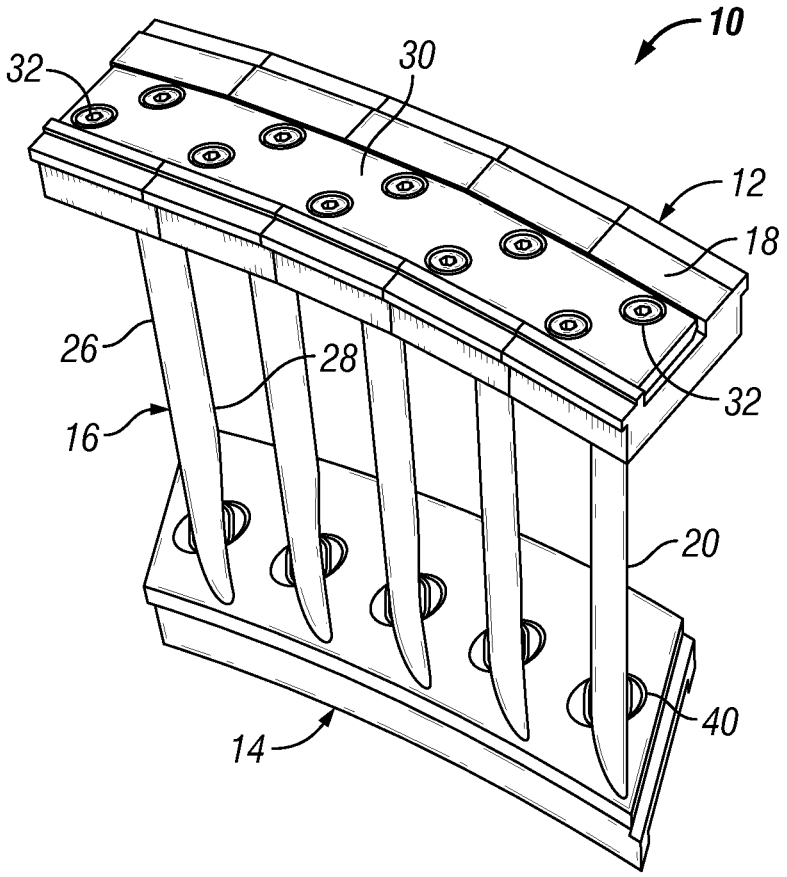
FIG. 1 illustrates a perspective view of a portion of an illustrative compressor vane assembly, according to an exemplary embodiment.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 2:
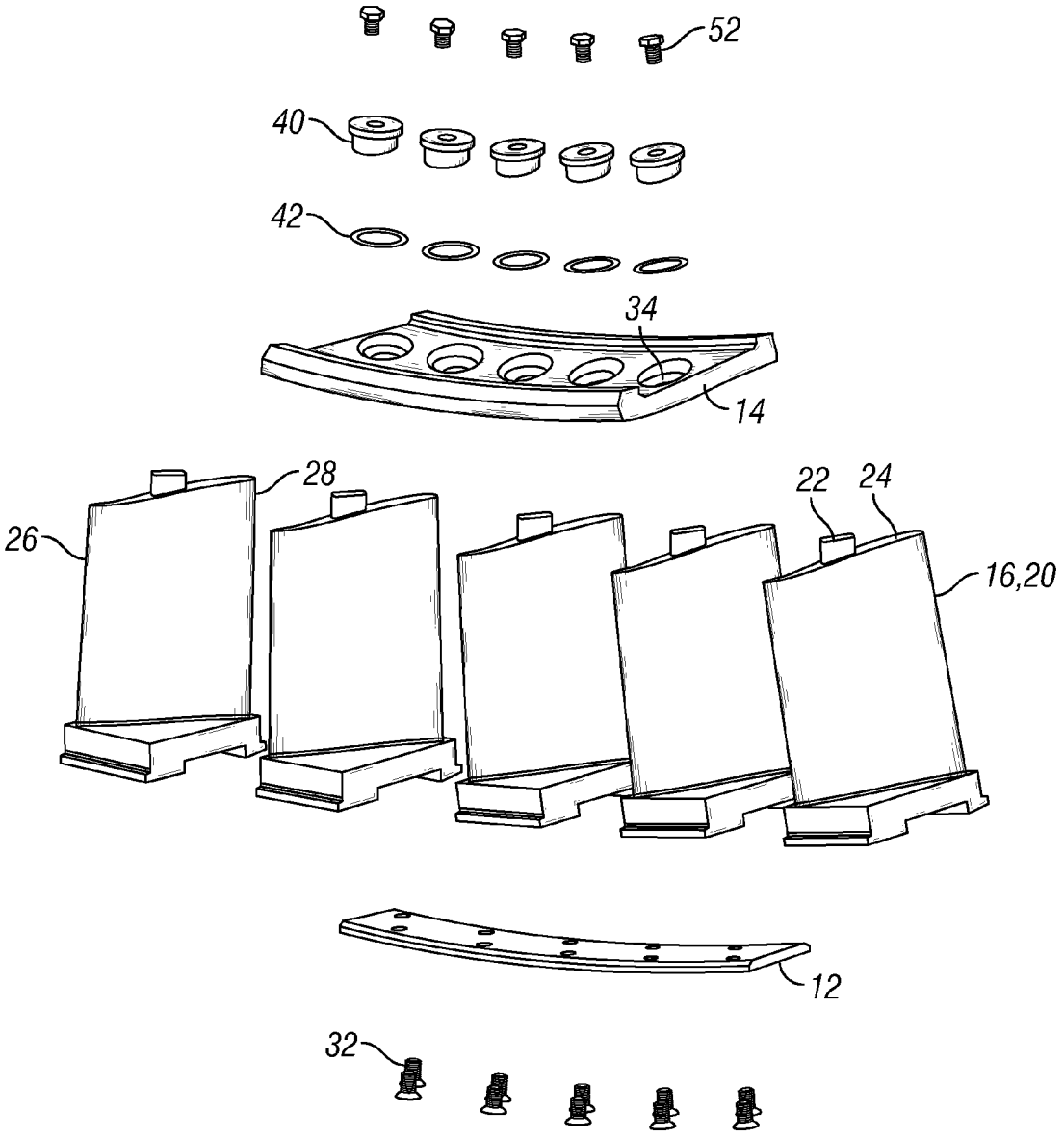
FIG. 2 illustrates an exploded perspective view of the portion of the compressor vane assembly as shown in FIG. 1.

FIG. 1 illustrates a perspective view of a portion of a compressor vane assembly 10, and FIG. 2 illustrates an exploded perspective view of the portion of the compressor vane assembly 10 shown in FIG. 1, according to an exemplary embodiment. The compressor vane assembly 10 may be or include a stage seventeen compressor vane assembly of the commercially-available GE 7FA+e multistage gas turbine.

The compressor vane assembly 10 includes an outer shroud, referred to as a stator vane segment 12 and an inner shroud, referred to as an inner shroud segment 14. The stator vane segment 12 and the inner shroud segment 14 form concentric rings disposed within a casing (not shown) of the gas turbine (not shown) about a shaft (not shown), such that the stator vane segment 12 has a greater radius than the inner shroud segment 14.

The stator vane segment 12 may be made up of a plurality of stator vanes 16 (e.g., five stator vanes 16), and the stator vanes 16 may be disposed between and coupled to the stator vane segment 12 and the inner shroud segment 14. Each of the stator vanes 16 includes a dove tail mounting portion 18 and an airfoil portion 20. The dovetail mounting portions 18 of the stator vanes 16 may be coupled together via a ganging plate 30 and a plurality of stator vane segment bolts 32. The stator vane segment bolts 32 may be ¼-20 countersunk screws.

Each stator vane 16 further includes a radially-extending tenon 22 that extends from a radially inner tip 24 of the stator vane 16. The tenon 22 may be round or oval in cross-section and may be positioned between the forward (i.e., leading) and trailing edges 26, 28 of the airfoil portion 20. The inner shroud segment 14 defines a plurality of apertures or openings 34 formed therethrough at spaced intervals circumferentially about the inner shroud segment 14 and configured to align with the tenons 22. The openings 34 are adapted to receive a corresponding bushing 40 and/or a washer 42, as described in greater detail below.

Figure 3:
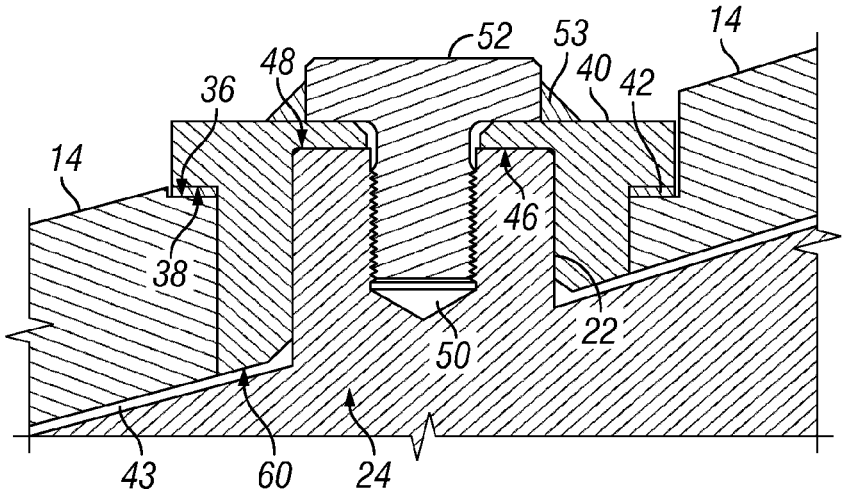
FIG. 3 illustrates a cross-sectional view of the connection between the tenon, the bushing, and the inner shroud, according to an exemplary embodiment.
Figure 4:
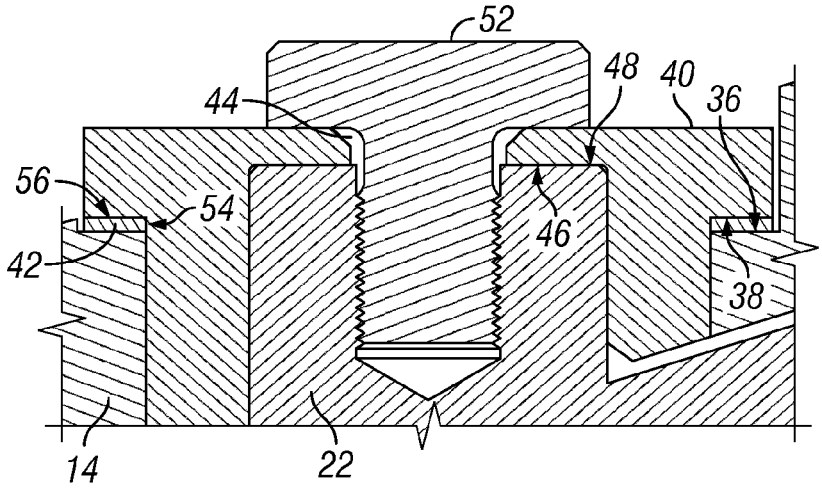
FIG. 4 illustrates a magnified cross-sectional view of the connection as shown in FIG. 3.

FIG. 3 illustrates a cross-sectional view of the connection between the tenon 22, the bushing 40, and the inner shroud segment 14, and FIG. 4 illustrates a magnified cross-sectional view of the connection as shown in FIG. 3, according to an exemplary embodiment. The openings 34 (see FIG. 2) in the inner shroud segment 14 may be counterbored in a radially-outward direction to create a shoulder 36 that faces radially-inward. The shoulder 36 in the inner shroud segment 14 is configured to contact or abut a corresponding shoulder 38 that faces radially-outward formed in the bushing 40. A washer 42 may be disposed between the shoulder 36 of the inner shroud segment 14 and the shoulder 38 of the bushing 40. The bushing 40 further defines a center bushing mortise or opening 44 that is counterbored and further configured to provide an annular (or oval)-shaped, radially-outwardly facing seat 46 configured to be engaged by at least a portion of an end face 48 of the tenon 22. Each tenon 22 may define an opening 50 configured to be aligned with the opening 44 in the bushing 40 and to receive a threaded tenon bolt 52. The threaded tenon bolt 52 may be a hexagonal, A-286 stainless steel bolt as provided by the manufacturer. In at least one embodiment, the threaded tenon bolt 52 may be welded to the bushing 40 at 53.

In the exemplary embodiment, the bushing 40 may be constructed of 316 stainless steel while the airfoil portion 20 (including the tenons 22) and the inner shroud segment 14 may be constructed of a harder 400 series stainless steel; however, as may be appreciated, the material compositions may vary.

To form the compressor vane assembly 10, each aperture 34 (see FIG. 2) in the inner shroud segment 14 receives a respective washer 42 and bushing 40 such that the washer 42 is seated on the shoulder 36 of the inner shroud segment 14. The bushing 40 is then seated on the washer 42 and disposed at least partially in the aperture 34 in the inner shroud segment 14 such that the washer 42 is disposed between the shoulder 36 of the inner shroud aperture 34 and the shoulder 38 of the bushing 40. A respective tenon 22 is inserted into the opening 44 in the bushing 40 until at least a portion of the end face 48 of the tenon 22 is fully engaged with the seat 46 of the bushing 40.

A spacing or void 43 is formed between the radial inner tip 24 of the stator vane 16 and the inner shroud segment 14 as the end face 48 of the tenon 22 engages the seat 46 of the bushing 40. The threaded tenon bolt 52 may be threaded through the opening 44 in the bushing 40 and into the opening 50 in the tenon 22, thereby coupling the stator vane 16 to the inner shroud segment 14. The head of the threaded tenon bolt 52 may then be welded to the bushing 40 to provide additional support to the coupling of the tenon 22 and inner shroud segment 14. As stated above, the opposing portion of each stator vane 16 (including the dove tail portion 18) may be secured to the stator vane segment 12. More particularly, the dove tail portions 18 of the stator vanes 16 may be coupled together via the ganging plate 30 and a plurality of stator vane segment bolts 32.

As stated above, in operation, the GE 7FA+e has been known to suffer from multiple flaws in the stage seventeen compressor vane assembly 10. In some instances, the known flaws may result in the yielding or breaking of at least one of the threaded tenon bolts 52 securing a respective stator vane 16 to the inner shroud segment 14 of the compressor vane assembly 10. In other instances, the flaws may cause stripping of the threaded tenon bolt 52 or a threaded portion of the tenon 22 to occur, thereby causing a failure in connection between the stator vane 16 and the inner shroud segment 14 via the aforementioned threaded tenon bolt 52.

Several theories have been postulated as to the cause of the failure in connection between the stator vane 16 and the inner shroud segment 14 via the aforementioned threaded tenon bolt 52. General Electric has indicated that the cause of the yielding may be due to the heat from welding the threaded tenon bolt 52 to the bushing 40. The applied heat may weaken the threaded tenon bolt 52, causing it to yield during service with a resultant loss of preload to the bolt/bushing/washer/compressor vane assembly. The force that causes the threaded tenon bolt 52 to yield or break may be applied by the inner shroud segment 14, as the inner shroud segment 14 is concentric with the turbine casing but tends to flatten out in operation, thereby applying a load to the head of the threaded tenon bolt 52.

Another theory provided by those of skill in the art is directed to the washer 42 disposed between the shoulder 36 of the inner shroud segment 14 and the shoulder 38 of the bushing 40. The washer 42 may be loose. Even when the threaded tenon bolt 52 has been tightened to specification and retains the bushing 40, the inner shroud segment 14 may not be rigidly held, thereby enabling the washer 42 to vibrate. Such vibration typically results in the movement of the washer 42 against the bushing 40 and the inner shroud segment 14 causing deformations, including the weakening and tearing of the inner shroud segment 14 and/or the bushing 40. Further, the inner shroud segment 14 is also free to vibrate and exert a cyclic load on the underside of the threaded tenon bolt 52, as the void 43 formed between the inner shroud segment 14 and the respective stator vane 16 allows for movement of the inner shroud segment 14. Such exertion may also cause the threads disposed on the outer surface of the tenon 22 to strip. Further, it has been observed that the bushing 40 grinds on the top of the tenon 22 in some instances, which may also lead to the loss of the threaded tenon bolt 52 preload.

Other theories provided by skilled artisans are directed to a combination of scenarios occurring during the operation of the gas turbine, including the threaded tenon bolt 52 yielding, losing fatigue capability from heat exposure, and being inadequately preloaded/damped to prevent fatigue failure. In addition, it is believed that engine operation may be a contributor as well, and may drive certain modes of operation to be more prone to the fatigue failure. The loading mechanism may likely be fatigue, as opposed to tensile overload. This may be a combination of low-cycle load from plate flattening (as described above) and/or high-cycle fatigue which would be from (possibly intermittent) aeromechanical vibration not necessarily associated with plate flattening.

In analyzing the failure of the connection between the stator vane 16 and the inner shroud segment 14, it is believed that the following explanations may be consistent with the failures observed by those of skill in the art. Regarding the failure of the threaded tenon bolt 52, it is believed that the weld debits the capability of the threaded tenon bolt 52 upon application of the weld material to the head of the threaded tenon bolt 52. As the compressor vane assembly 10 goes through transients with separated flow and aero-acoustic instability, the transients drive high frequency vibration at amplitudes higher than would occur in a properly bolted joint, resulting over time in cracking in the threaded tenon bolt 52 or the threaded vane attachment ultimately failing. Regarding the failure of the threaded tenon bolts 52 away from the heat affected zone and/or where the threads on the tenon 22 of the stator vane 16 became stripped or otherwise fail, loss of preload may compromise the bolted joint and its fatigue capability at locations on the bolted joint.

Another possible cause for the failure of the connection between the stator vane 16 and the inner shroud segment 14 may include cyclic rotational and lateral movement of the airfoil 20 causing the bolt 52 to rotate about 4.6 degrees counterclockwise and lose preload. The bolt 52 may then be loose and subjected to forces applied by the bushing 40, the inner shroud segment 14, and the airfoil 20.

Although more than one explanation for the connection failure between the inner shroud segment 14 and one or more stator vanes 16 may be provided as described above, General Electric has concluded that at least the heat applied to the threaded tenon bolt 52 during the manufacturing process is responsible for the connection failure. In accordance with such a conclusion, General Electric has introduced a modified design in which the bushing 40 has a slot milled into it, the threaded tenon bolt 52 has an integral washer, and the integral washer is then staked into the slot in the bushing 40 to prevent the threaded tenon bolt 52 from rotating. In doing so, the entire compressor vane assembly 10 is replaced with the new design.

Figure 5:
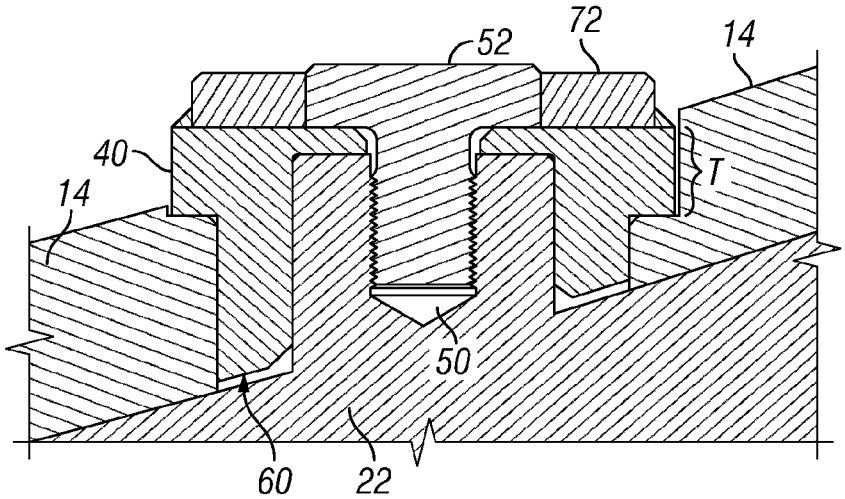
FIG. 5 illustrates a cross-sectional view of the connection shown in FIGS. 3 and 4 after being repaired.

FIG. 5 illustrates a cross-sectional view of the connection shown in FIGS. 3 and 4 after being repaired. In an exemplary embodiment, a method may be provided for repairing the failure in connection between at least one stator vane 16 and the inner shroud segment 14 of the compressor vane assembly 10. The method may provide for anti-rotation of the threaded tenon bolt 52, and also reduce or eliminate the risks associated with welding directly on the head of the threaded tenon bolt 52. As disclosed above, the compressor vane assembly 10 of the GE 7FA+e includes a washer 42 disposed between the bushing 40 and inner shroud segment 14 at each defined inner shroud aperture 34. In an exemplary embodiment, the method includes removing the washer 42 disposed between the bushing 40 and inner shroud segment 14, as shown in FIG. 5. The removal of the washer 42 may prevent the washer 42 from vibrating during operation. This vibration may cause the washer 42 to move against the inner shroud segment 14 and the bushing 40, causing deformations, including the tearing and weakening of the inner shroud segment 14 and/or the bushing 40.

As shown in FIG. 3, and more clearly in FIG. 4, the bushing 40 forms a fillet radius 54 proximate the shoulder 38 of the bushing 40. Such a fillet radius 54 may cause a gap or spacing 56 to occur between the washer 42 and the bushing 40. In an embodiment in which the washer 42 is removed, the gap or spacing 56 may occur between the inner shroud segment 14 and the bushing 40. Further, as disclosed above, the removal of the washer 42 may provide for a better seating of the bushing 40 on the inner shroud segment 14, thereby reducing the spacing 56 therebetween. In doing so, a bottom portion 60 of the bushing 40 may prevent the proper seating of the bushing 40 on the inner shroud segment 14 due to the bottom portion 60 of the bushing contacting the airfoil portion 20, thereby obstructing the seating of the shoulder 38 of the bushing 40 on the shoulder 36 of the inner shroud segment 14. Accordingly, in an exemplary embodiment, the bottom portion 60 of the bushing 40 may be removed or altered in such a manner that the shoulder 38 of the bushing 40 may engage and be seated on the shoulder 36 of the inner shroud segment 14. For example, 0.050" (1.27 mm) of the bottom portion 60 of the bushing 40 may be removed (e.g., by machining). Embodiments in which an amount greater or less than 0.050" (1.27 mm) of the bottom portion 60 is removed are also contemplated herein.

In an exemplary embodiment, the bushing 40 may be modified to increase the thickness T of the shoulder 38 of the bushing 40 upon removal of the washer 42 to compensate for space previously filled by the washer 42. The increase in the thickness T of the shoulder 38 may reduce the spacing 56, thereby reducing the void 43 formed between the inner shroud segment 14 and the respective stator vane 16. Reducing the void 43 therebetween provides for a reduction in vibration between the inner shroud segment 14 and the stator vane 16.

Figure 6:
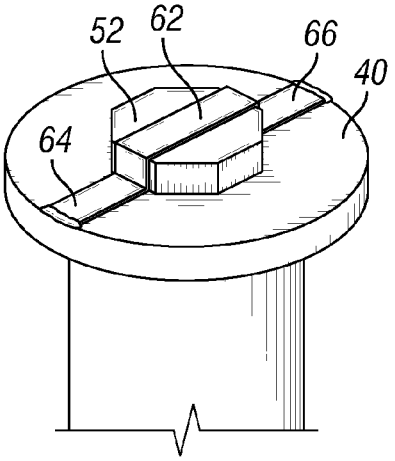
FIG. 6 illustrates a perspective view of a bolt restraining strap welded to the bushing, according to an exemplary embodiment.

In addition to the foregoing embodiments, other exemplary embodiments of a method for repairing the failure in connection between at least one stator vane 16 and the inner shroud segment 14 of the compressor vane assembly 10 are illustrated at least in part in FIGS. 6-14. FIG. 6 illustrates an exemplary bolt retaining strap 62 utilized in an exemplary embodiment of the method. The bolt restraining strap 62 may be formed from a strip of sheet metal and configured to retain the threaded tenon bolt 52 in the opening 44 in the bushing 40 and the opening 50 in the tenon 22 such that the stator vane 16 and inner shroud segment 14 are coupled together.

The bolt retaining strap 62 may form a plurality of bends, illustrated as four bends, such that the bolt retaining strap 62 covers a side portion, the top portion, and an opposing side portion of the threaded tenon bolt 52. The bolt retaining strap 62 further includes a first end 64 and a second end 66. The first end 64 of the bolt retaining strap 62 is welded to the bushing 40 at a first location proximate the (outer radial) periphery of the bushing 40, and the second end 66 of the bolt retaining strap 62 is welded to the bushing 40 proximate a second location, directly opposing the first location, on the periphery of the bushing 40. By welding the bolt retaining strap 62 at the respective locations on the periphery of the bushing 40, the heat from the weld may be kept well away from the threaded tenon bolt 52. In addition, the method may include closely controlling the weld parameters and associated temperatures. For example, the temperature of the threaded tenon bolt 52 may be maintained at about 100° F. as the bolt retaining strap 62 is welded to the bushing 40.

Figure 7:
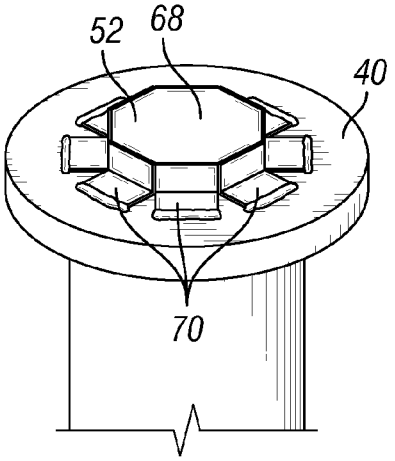
FIG. 7 illustrates a perspective view of a plurality of bolt restraining straps welded to the bushing, according to an exemplary embodiment.

As shown in FIG. 7, an exemplary embodiment may include the utilization of a plurality of bolt retaining straps 62, the plurality of bolt retaining straps 62 form a hexagonal retaining strap 68. The hexagonal retaining strap 68 may cover the top portion and each side portion of the threaded tenon bolt 52. As shown, the hexagonal retaining strip 68 includes at least six retaining strap ends 70, each extending from a side of the threaded tenon bolt 52 and welded to the bushing 40 at a respective location on the periphery of the bushing 40. By welding the strap ends 70 of the retaining strip 68 at the respective locations on the periphery of the bushing 40, the heat from the weld is thereby kept well away from the threaded tenon bolt 52. In addition, the method may include closely controlling the weld parameters and associated temperatures. For example, the temperature of the threaded tenon bolt 52 may be maintained at about 100° F. as the plurality of bolt retaining straps 62 are welded to the bushing 40.

Figure 8:
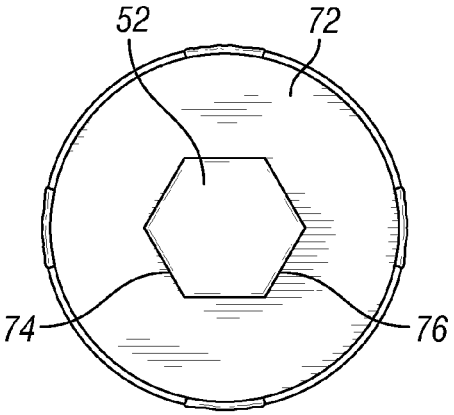
FIG. 8 illustrates a top plan view of a retaining washer welded to the bushing, according to an exemplary embodiment.

An exemplary embodiment may utilize a retaining washer 72 in a method for repairing the failure in connection between the stator vane 16 and the inner shroud segment 14 of the compressor vane assembly 10, as illustrated in FIGS. 5 and 8. The retaining washer 72 may have an opening 74 formed therethrough configured to prevent the head of the threaded tenon bolt 52 from rotating in relation to the bushing 40 and/or tenon 22. In an exemplary embodiment, the retaining washer 72 may be formed from 316 Stainless Steel and have a thickness of about 0.125" (3.18 mm). The retaining washer 72 may include at least two flat or planar sidewalls 76. As shown, the retaining washer 72 includes six planar sidewalls 76 such that the opening 74 is hexagonal. Each sidewall 76 may be positioned adjacent to a respective side of the threaded tenon bolt 52, such that the threaded tenon bolt 52 is restrained from moving/rotating relative to the bushing 40 when the retaining washer 72 is disposed on the bushing 40.

Embodiments in which the retaining washer 72 includes more or less than six planar sidewalls 76 forming the opening 74 are contemplated herein. For example, the retaining washer 72 may include two planar sidewalls 76, and each planar sidewall 76 may be parallel and opposite to the other planar sidewall 76. The planar sidewalls 76 may be coupled to one another by opposing arcuate sidewalls, thereby forming the center opening 74. In another example, the retaining washer 72 may include two planar sidewalls 76 adjacent and coupled to one another at an end of each planar sidewall 76. The opposing ends of each planar sidewall 76 may be coupled to one another by an arcuate sidewall, thereby forming the center opening 74 defined in the retaining washer 72.

The retaining washer 72 may be disposed on the bushing 40 and welded to the bushing 40 at a plurality of locations along the (outer radial) periphery of the bushing 40. By welding the retaining washer 72 at the respective locations on the periphery of the bushing 40, the heat from the weld is thereby kept well away from the threaded tenon bolt 52. In addition, the method may include closely controlling the weld parameters and associated temperatures. For example, the temperature of the threaded tenon bolt 52 may be maintained at about 100° F. as the retaining washer 72 is welded to the bushing 40.

Figure 9:
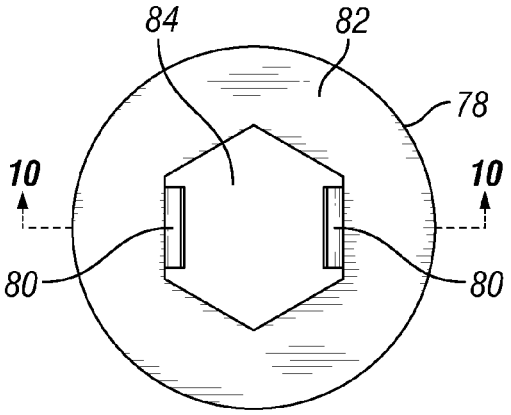
FIG. 9 illustrates a top plan view of a retaining washer prior to installation, according to an exemplary embodiment.
Figure 10:
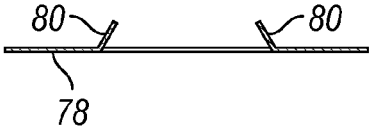
FIG. 10 illustrates a sectional view of the retaining washer taken along the line 10-10 as shown in the embodiment of FIG. 9.
Figure 11:
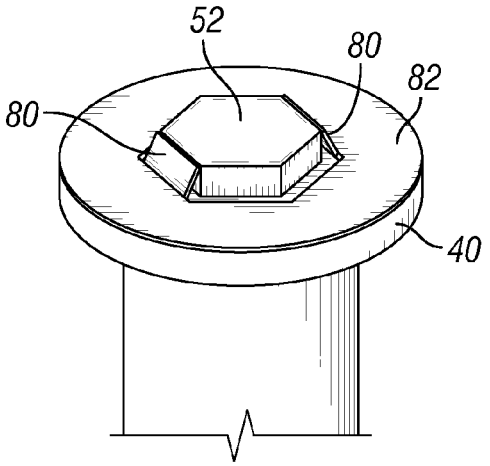
FIG. 11 illustrates a perspective view of the retaining washer of FIGS. 9 and 10 assembled to the bushing.

In an exemplary embodiment shown in FIGS. 9-11, the method may include the utilization of another illustrative retaining washer 78 including a plurality of tabs 80 projecting from a surface 82. The retaining washer 78 may have an opening 84 formed therethrough that is configured to prevent the threaded tenon bolt 52 from rotating in relation to the bushing 40 and/or tenon 22. The plurality of tabs 80 may include two tabs 80 projecting from opposing sides of the surface 82 defining the opening 84, such that the two tabs 80 prevent the threaded tenon bolt 52 from rotating in relation to the bushing 40 and/or the tenon 22. The retaining washer 78 may be disposed on the bushing 40 and welded to the bushing 40 at a plurality of locations along the (outer radial) periphery of the bushing 40. By welding the retaining washer 78 at the respective locations on the periphery of the bushing 40, the heat from the weld is thereby kept well away from the threaded tenon bolt 52. In addition, the method may include closely controlling the weld parameters and associated temperatures. For example, the temperature of the threaded tenon bolt 52 may be maintained at about 100° F. as the retaining tabbed washer 78 is welded to the bushing 40.

Figure 12:
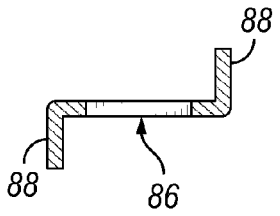
FIG. 12 illustrates a side view of a washer configured to be coupled to the bushing, according to an exemplary embodiment.
Figure 13:
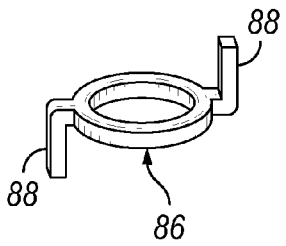
FIG. 13 illustrates a perspective view of the washer of FIG. 12.

In an embodiment illustrated in FIGS. 12 and 13, the method may include the utilization of another illustrative washer 86. The washer 86 may include a plurality of axially-extending tabs 88, such that at least one tab 88 may be bent against the periphery of the bushing 40, and at least one other tab 88 may be bent against the threaded tenon bolt 52, thereby preventing the threaded tenon bolt 52 from moving/rotating relative to the bushing 40 and/or tenon 22.

Figure 14:
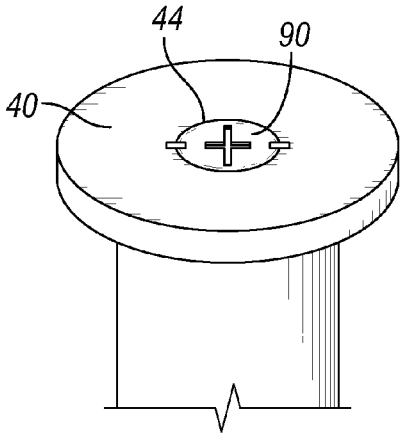
FIG. 14 illustrates a perspective view of an extended bushing defining an extended center bushing opening configured to receive a countersunk screw, according to an exemplary embodiment.

As shown in FIG. 14, the method may include the utilization of a bushing 40 including an extended center bushing opening 44 configured to receive a countersunk screw 90 that may be secured to the bushing 40 by staking or tack welding. In an exemplary embodiment, the head of the screw 90 may be seated flush with the surface of the bushing 40.

Figure 15:
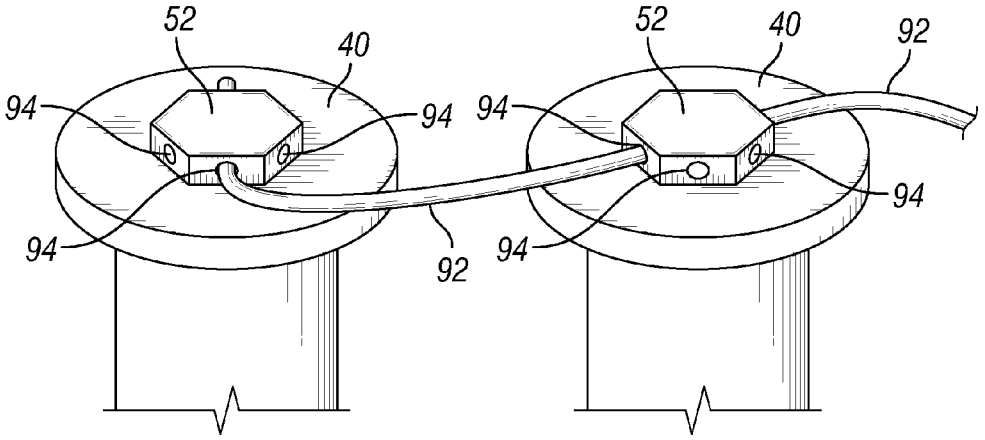
FIG. 15 illustrates a perspective view of a lock wire coupling a threaded tenon bolt to an adjacent threaded tenon bolt, according to an exemplary embodiment.

As shown in FIG. 15, the method may include the utilization of a lock wire 92 to secure a first threaded tenon bolt 52 to a second, adjacent threaded tenon bolt 52. Each threaded tenon bolt 52 may define a plurality of bolt passageways 94 configured to receive and pass the lock wire 92 therethrough. The lock wire 92 may be formed from braided stainless steel, Monel®, Inconel®, and the like.

In an embodiment, the method may include the utilization of an inner shroud segment 14 including an integral bushing. The integral bushing defines a center bushing opening configured to receive the threaded tenon bolt 52 therein. The threaded tenon bolt 52 may define a plurality of bolt passageways similar to those disclosed in FIG. 12, such that lock wire 92 may be received and passed therethrough. In an exemplary embodiment, the lock wire 92 may couple the threaded tenon bolt 52 to the inner shroud segment 14 including the integral bushing.

Figure 16:
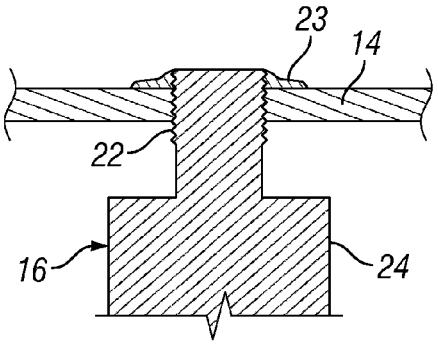
FIG. 16 illustrates a cross-sectional view of an inner shroud segment defining a slot and coupled to a tenon, according to an exemplary embodiment.

In an embodiment shown in FIG. 16, the method may include the utilization of an inner shroud segment 14 defining a plurality of slots. Each slot may be configured to receive a respective tenon 22. The tenon 22 may be welded to the inner shroud segment 14 at weld point 23, thereby connecting the stator vane 16 to the inner shroud segment 14. In such an embodiment, the threaded tenon bolt 52 and the bushing 40 may be removed.

As stated above, the threaded tenon bolt 52 may be an A-286 stainless steel bolt as provided by the manufacturer. Also, as discussed above, the threaded tenon bolt 52 has been known to fail as originally installed in the GE 7FA+e stage seventeen compressor vane assembly 10. In an exemplary embodiment, the method may include a bolt made of a nickel-based superalloy, such as Inconel®. In doing so, the threaded tenon bolts 52 formed from A-286 stainless steel may be removed from the compressor vane assembly 10 and replaced with respective Inconel® bolts, e.g., Inconel 718 bolts.

In addition to embodiments directed to the repair of the compressor vane assembly 10 exhibiting problems related to the yielding and breaking of the threaded tenon bolt 52 as described above, embodiments in the present disclosure may provide solutions for repairing a stripped thread on the outer surface of the tenon 22. In an exemplary embodiment, a method may include adding a countersink to the top portion of the tenon 22 to remove a stress concentration on the threaded tenon bolt 52. The method may also include the utilization of a helical insert in the top portion of the tenon 22. The helical insert may prevent the stripping of threads on the inner surface the tenon 22 defining the opening 50 in the tenon 22. The helical inserts may provide permanent conventional sixty degree internal screw threads in an exemplary embodiment. The helical inserts may be disposed in a respective opening 50 in the tenon 22 of the inner shroud segment 14. For example, the helical insert may be a Heli-Coil® Screw-Locking Insert manufactured by Emhart Teknologies of Shelton, Conn. In addition to inserting helical inserts, in an embodiment, the method may include welding and re-cutting the thread formed in the tenon 22.

In addition to the embodiments disclosed above, the method may include other embodiments directed to providing a solution for countering vibration leading to loosening of the threads on the threaded tenon bolt 52. In an exemplary embodiment, the method may include the utilization of a locking washer under the threaded tenon bolt head 52 that may be a locking washer manufactured by Nord-Lock® of Elk Grove Village, Ill. to prevent movement upon application of any vibration or dynamic loads.

In addition to the utilization of the helical insert above to provide solutions for repairing a stripped thread in the tenon 22, the helical insert such as Heli-Coil® Screw-Locking Insert in the opening 50 in the tenon 22 may be used to reduce vibrations which may lead to the loosening of the threads on the threaded tenon bolt 52. Further, in an embodiment, the method may include the utilization of a spring device that may be a washer that maintains its spring temper at operating temperatures and exerts a preload on the threaded tenon bolt 52. This may be a high-temperature Belleville, accordion, leaf or similar washer/shim for enhanced, long-term damping capability.

Returning now to FIG. 5, an exemplary method for repairing a failure in connection between the stator vane 16 and the inner shroud segment 14 is provided for the repaired compressor vane assembly 10. The method may include removing scale via 220 grit blasting. The shoulder 36 of the inner shroud segment 14 may be welded and re-machined to repair wear. Further, the seal land may be welded and re-machined to repair wear. The method may also include restoring the threads in the top portion of the tenon 22 defining the opening 50 in the tenon 22 by at least one of welding and rethreading, adding a helicoil (e.g., standard or vibration resistant), and inertia welding a replacement tenon 22 to the top portion of the stator vane 16 as required.

As shown in FIG. 5, the method may further include replacing the threaded tenon bolt 52 formed from A-286 stainless steel with a threaded tenon bolt 52 formed from Inconel 718 and removing/eliminating the washer 42. The bushing 40 may be modified by altering the bottom portion 60 of the bushing 40 such that the bottom portion 60 is about 0.050" (1.27 mm) shorter, and may further be altered by increasing the thickness T of the flange, or the shoulder 38 of the bushing 40 to compensate for the removal of the washer 42. The method may further include manufacturing replacement bushings 40 to meet the above alteration requirements.

As shown in FIG. 5, an exemplary embodiment of the method includes eliminating the weld between the threaded tenon bolt 52 and the bushing 40, and disposing the retaining washer 72 on the modified bushing 40. The retaining washer 72 may define a hexagonal center opening 74 (see FIG. 8) configured to prevent the head of the threaded tenon bolt 52 from rotating in relation to the bushing 40 and/or tenon 22. As disposed on the bushing 40, the retaining washer 72 may be welded to the bushing 40 at a plurality of locations along the periphery of the bushing 40. By welding the retaining washer 72 at the respective locations on the periphery of the bushing 40, the heat from the weld is thereby kept well away from the threaded tenon bolt 52. The flange may also be thickened to close down the gap 43 between the tip 24 of the stator vane segment 16 and the underside of the inner shroud segment 14.

Figure 17:
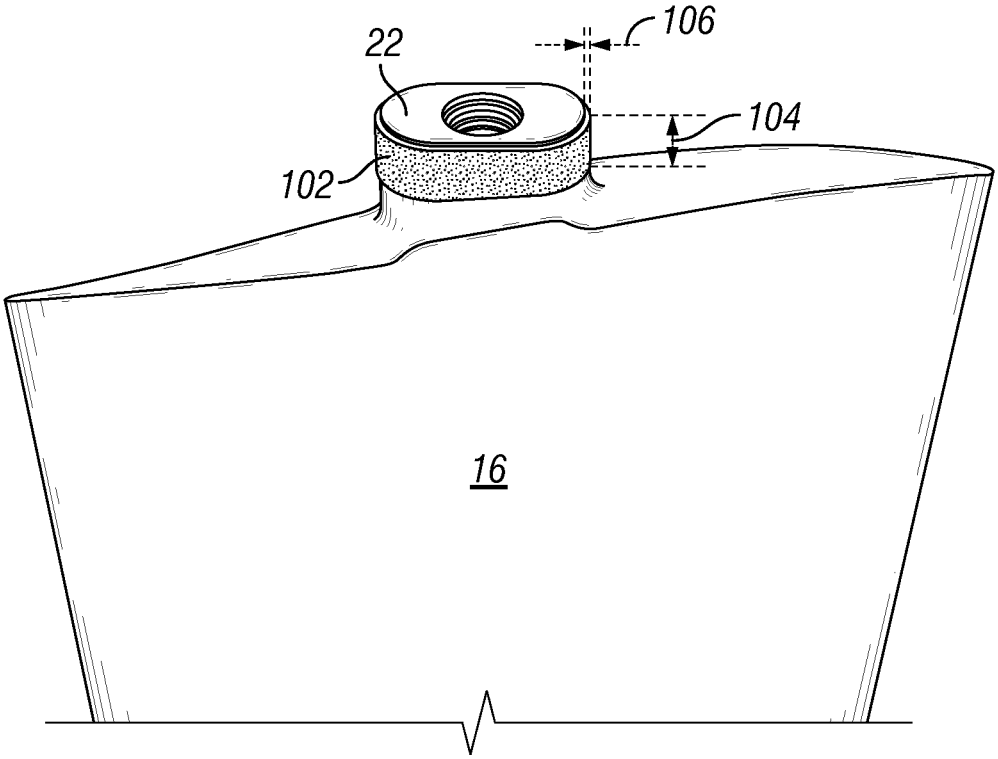
FIG. 17 illustrates a perspective view of an illustrative coating on the tenon of the stator vane, according to an exemplary embodiment.

FIGS. 17-20 illustrate another exemplary method for repairing a failure in the connection between the stator vane 16 and the inner shroud segment 14. More particularly, FIG. 17 illustrates a perspective view of an illustrative coating 102 on the tenon 22 of the stator vane 16, according to an exemplary embodiment. The coating 102 may be applied to and/or disposed on the outer surface of the tenon 22. More particularly, the coating 102 may be applied to and/or disposed on the outer side surface of the tenon 22 (as opposed to the outer axial end surface).

The coating 102 may include any material that has a melting point above about 100° F. and will peel or shave as the bushing 40 is pressed on the tenon 22. In at least one embodiment, the coating 102 may include aluminum. For example, illustrative coatings 102 may be or include AWS C2.25/C2.25M:2002, ISO 14919:2001, Code 3.2, Symbol A199,5, or EN 10204:2004 3.1. The coating 102 may be an epoxy, a tape, or the coating 102 may be applied to the tenon 22 via wire-arc spray.

The coating 102 may have a height 104 that is less than or equal to the height of the tenon 22 (e.g., about 0.438" or 11.1 mm). In at least one embodiment, the coating 102 may have a height 104 ranging from about 0.01" (0.25 mm), about 0.05" (1.27 mm), about 0.10" (2.54 mm), about 0.15" (3.81 mm), about 0.20" (5.08 mm), or about 0.25" (6.35 mm) to about 0.30" (7.62 mm), about 0.35" (8.89 mm), about 0.40" (10.2 mm), about 0.45" (11.4 mm), about 0.50" (12.7 mm), or more. For example, the height 104 may be from about 0.01" (0.25 mm) to about 0.50" (12.7 mm), about 0.10" (2.54 mm) to about 0.35" (8.89 mm), or about 0.15" (3.81 mm) to about 0.25" (6.35 mm).

The coating 102 may have a thickness 106 ranging from about 0.001" (0.025 mm), about 0.002" (0.051 mm), about 0.003" (0.076 mm), about 0.004" (0.10 mm), or about 0.005" (0.13 mm) to about 0.006" (0.15 mm), about 0.008" (0.20 mm), about 0.010" (0.25 mm), about 0.015" (0.38 mm), about 0.020" (0.51 mm), about 0.025" (0.64 mm), about 0.030" (0.76 mm), about 0.040" (1.02 mm), or more. For example, the thickness 106 may be from about 0.001" (0.025 mm) to about 0.020" (0.51 mm), about 0.002" (0.051 mm) to about 0.015" (0.38 mm), or about 0.003" (0.076 mm) to about 0.010" (0.25 mm).

Figure 18:
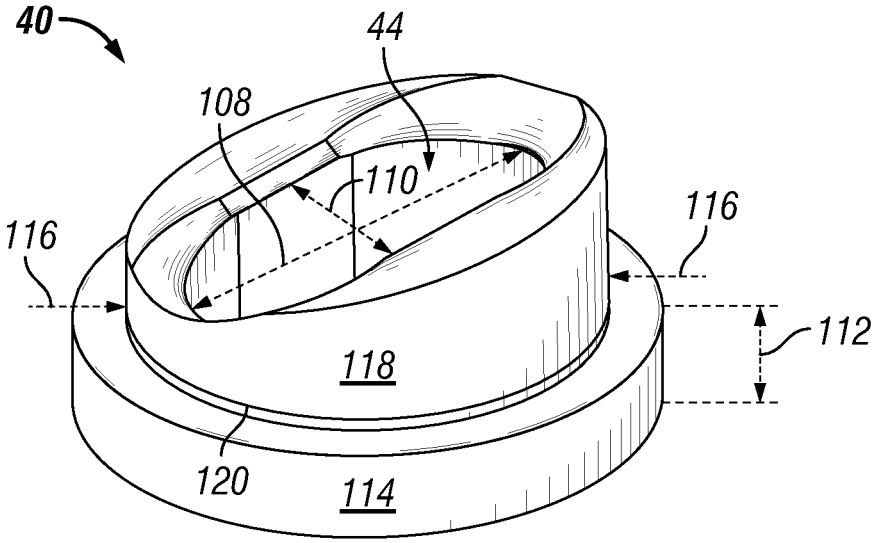
FIG. 18 illustrates a perspective view of an illustrative bushing, according to an exemplary embodiment.

FIG. 18 illustrates a perspective view of an illustrative bushing 40, according to an exemplary embodiment. The opening 44 in the bushing 40 may have a length 108 and a width 110, and the length 108 may be greater than the width 110. The width 110 of the opening 44 in the bushing 40 may be reduced (e.g., by replacing the original bushing with a new or different bushing or by computer numerical control machining), which thereby reduces the clearance with the tenon 22. After being reduced, the width 110 may range from about 0.400" (10.2 mm), about 0.405" (10.3 mm), about 0.410" (10.4 mm), about 0.415" (10.5 mm), or about 0.420" (10.7 mm) to about 0.425" (10.8 mm), about 0.430" (10.9 mm), about 0.435" (11.0 mm), about 0.440" (11.2 mm), about 0.445" (11.3 mm), or more. For example, after being reduced, the width 110 may be about 0.410" (10.4 mm) to about 0.430" (10.9 mm), about 0.414" (10.5 mm) to about 0.422" (10.7 mm), or about 0.416" (10.6 mm) to about 0.420" (10.7 mm). This may reduce the (radial) clearance between the tenon 22 and the bushing 40 from about 40% to about 60% (e.g., about 47%). For example, after the width 110 is reduced, the clearance may be from about 0.000" (i.e., a locational transition fit or interference fit) to about 0.020" (0.51 mm), about 0.004" (0.10 mm) to about 0.012" (0.31 mm), or between about 0.006" (0.15 mm) to about 0.010" (0.25 mm).

In another embodiment, a portion of the width 110 of the opening 44 in the bushing 40 may be reduced. For example, the opening 44 may be defined by one or more lobes that extend radially inward. The lobes may cause the profile of the opening 44 to resemble an hour glass. In yet another embodiment, the tenon 22 may be machined such that the tenon 22 is tapered. More particularly, one axial end portion of the tenon 22 may have a greater cross-sectional length (e.g., diameter) than the other axial end portion. As such, the tenon 22 may form a locational transition fit or interference fit with the opening 44 in the bushing 40.

The washer 42 may be removed and/or eliminated. As such, the height 112 of a head portion (i.e., flange) 114 of the bushing 40 may be increased by about the thickness of the washer 42 to reduce or eliminate the gap between the shoulder 38 of the bushing 40 and the shoulder 36 of the inner shroud segment 14. For example, the height 112 may be from about 0.125" (3.18 mm) to about 0.200" (5.08 mm), about 0.150" (3.81 mm) to about 0.175" (4.44 mm), or about 0.159" (4.04 mm) to about 0.169" (4.29 mm). The height 112 of the head portion 114 of the bushing 40 may be increased by replacing the original bushing with a new or different bushing.

An outer cross-sectional length (e.g., outer diameter) 116 of a shaft portion 118 of the bushing 40 may be increased to reduce the clearance between the outer surface of the shaft portion 118 and the inner surface of the inner shroud segment 14. For example, after being increased, the outer diameter 116 of the shaft portion 118 may be from about 0.850" (21.6 mm) to about 0.880" (22.4 mm) or about 0.860" (21.8 mm) to about 0.864" (21.9 mm). The outer cross-sectional length 116 of the shaft portion 118 of the bushing 40 may be increased by replacing the original bushing with a new/different bushing.

An undercut 120 (e.g., an annular undercut) may be formed in the shaft portion 118 of the bushing 40 proximate the head portion 114 of the bushing 40 to prevent the fillet of the inner shroud segment 14 from interfering with the bushing 40. The undercut 120 may be formed around at least a portion of the circumference of the bushing 40 and have a radial length ranging from about 0.002" (0.051 mm), about 0.004" (0.10 mm), about 0.006" (0.15 mm), about 0.008" (0.20 mm), or about 0.010" (0.25 mm) to about 0.012" (0.31 mm), about 0.014" (0.36 mm), about 0.016" (0.41 mm), about 0.018" (0.46 mm), about 0.020" (0.51), or more. For example, the radial length may be from about 0.002" (0.051 mm) to about 0.020" (0.51 mm), about 0.006" (0.15 mm) to about 0.014" (0.36 mm), or about 0.008" (0.20 mm) to about 0.012" (0.31 mm).

Figure 19:
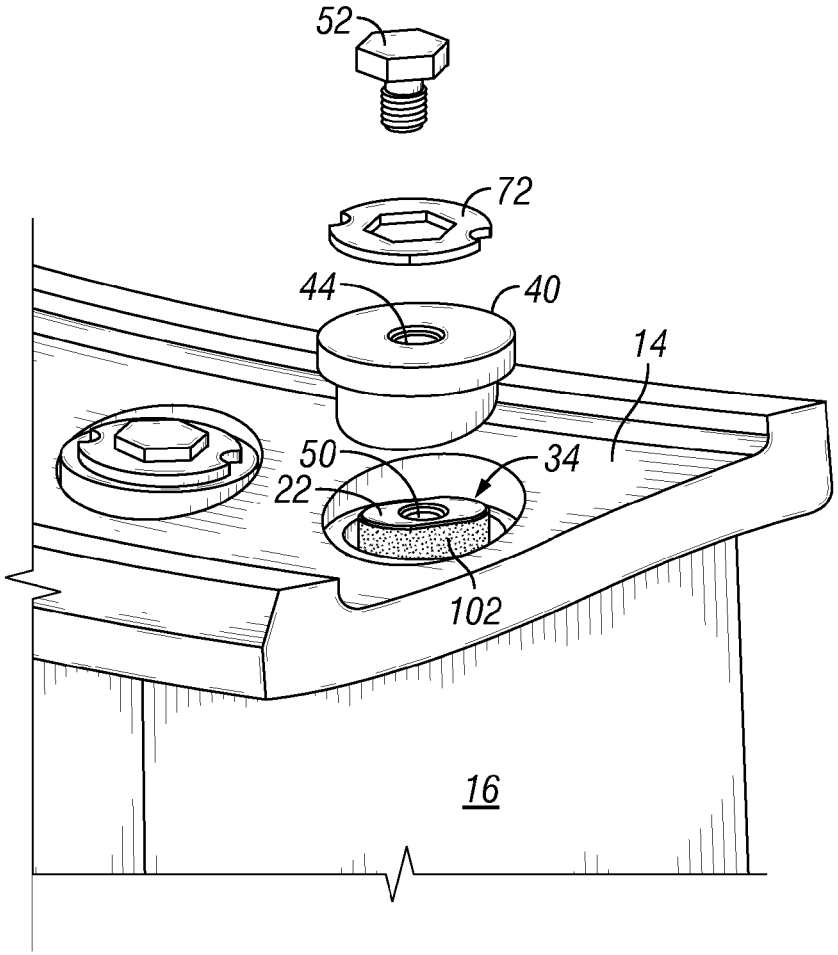
FIG. 19 illustrates an exploded perspective view of the tenon, the bushing, and the inner shroud segment, according to an exemplary embodiment.
Figure 20:
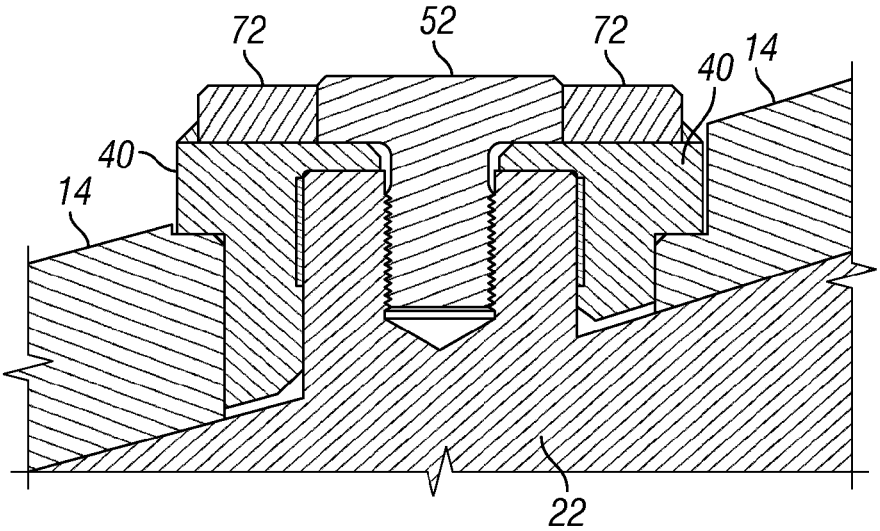
FIG. 20 illustrates a cross-sectional view of the tenon, the bushing, and the inner shroud segment, according to an exemplary embodiment.

FIG. 19 illustrates an exploded perspective view of the tenon 22, the bushing 40, and the inner shroud segment 14, and FIG. 20 illustrates a cross-sectional view of the tenon 22, the bushing 40, and the inner shroud segment 14, according to an exemplary embodiment. The tenon 22 of the stator vane 16 may be inserted into aperture 34 in the inner shroud segment 14. The bushing 40 may be at least partially inserted into the aperture 34 in the inner shroud segment 14 such that the tenon 22 becomes at least partially disposed within the opening 44 in the bushing 40.

The coating 102 on the outer surface of the tenon 22 may form a locational transition fit or interference fit between the tenon 22 and the bushing 40. This may reduce or eliminate rotational and/or translational movement therebetween. The coating 102 may be porous, which allows it to compress and/or smear to create the interference fit.

The threaded tenon bolt 52 may be inserted through the opening 44 in the bushing 40 and at least partially into the opening 50 in the tenon 22. The threads on the outer surface of the threaded tenon bolt 52 may engage the threads on the inner surface of the tenon 22. The retaining washer 72 may be disposed around at least a portion of the threaded tenon bolt 52. The retaining washer 72 may then be welded to the bushing 40. More particularly, the outer radial surface of the retaining washer 72 may be welded to the "top" surface of the bushing 40, as shown in FIG. 20. This may keep the heat generated during the welding process away from the threaded tenon bolt 52. An inner radial surface of the retaining washer 72 may include at least two planar surfaces 76 (see FIG. 8) that correspond to at least two planar surfaces of the threaded tenon bolt 52. As shown, the retaining washer 72 may include six planar surfaces 76 that form a hexagonal opening.

It should be noted that although above-mentioned embodiments are applicable in a method for repairing the failure in connection between at least one stator vane 16 of a plurality of stator vanes 16 and the inner shroud segment 14 of the compressor vane assembly 10, the above embodiments may be applicable to the assembly of new compressor vane assembles 10 as well to replace the original equipment manufactured components.

Further, it should be noted that the foregoing disclosure is not limited to the repair or modification of the GE 7FA+e (also known as 7241) gas turbine, but may further be applicable to other GE 7FA series gas turbines, the GE 7FB gas turbine, the GE 9FB gas turbine, and other like gas turbines having the aforementioned flaws in the manufacturing and design process.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A method for repairing a turbine, comprising:

applying a coating on an outer surface of a tenon extending from a stator vane;

inserting the tenon at least partially into an opening defined by an inner shroud segment of the turbine;

inserting a bushing at least partially into the opening in the inner shroud segment of the turbine such that the tenon becomes at least partially disposed within an opening defined by the bushing;

inserting a bolt through the opening in the bushing and at least partially into an opening defined by the tenon;

threadably engaging the bolt to the tenon; and further comprising welding a washer to the bushing, wherein the bolt extends through an opening defined by the washer.

2. The method of claim 1, wherein the coating provides a transition fit or an interference fit between the tenon and the bushing.

3. The method of claim 1, wherein a thickness of the coating is from about 0.001" to about 0.020".

4. The method of claim 1, wherein a height of the coating is from about 0.01" to about 0.50".

5. The method of claim 1, wherein the coating comprises aluminum.

6. The method of claim 1, wherein the outer surface of the tenon comprises an outer side surface.

7. The method of claim 1, wherein a height of a head portion of the bushing is from about 0.125" to about 0.200".

8. The method of claim 7, further comprising forming an undercut in a shaft portion of the bushing proximate the head portion of the bushing, the undercut having a radial length from about 0.002" to about 0.020".

9. The method of claim 1, wherein a width of the opening in the bushing is from about 0.410" to about 0.430".

10. A method for repairing a turbine, comprising:

inserting a tenon extending from a stator vane at least partially into an opening defined by an inner shroud segment of the turbine;

inserting a bushing at least partially into the opening in the inner shroud segment of the turbine such that the tenon becomes at least partially disposed within an opening defined by the bushing;

inserting a bolt through the opening in the bushing and at least partially into an opening defined by the tenon;

threadably engaging the bolt to the tenon, wherein a washer is disposed around at least a portion of the bolt and prevents the bolt from rotating to disengage the tenon; and further comprising welding the washer to the bushing proximate an outer radial surface of the washer.

11. The method of claim 10, wherein an inner radial surface of the washer includes at least two planar surfaces that correspond to at least two planar surfaces on an outer radial surface of the bolt.

12. The method of claim 11, wherein the washer includes six planar surfaces forming a hexagonal opening.

13. The method of claim 10, wherein a clearance between the tenon and the bushing is from about 0.000" to about 0.012".

14. A repaired portion of a turbine, comprising:

an inner shroud segment defining an opening extending therethrough;

a stator vane having a tenon extending therefrom, wherein the tenon is at least partially disposed within the opening in the inner shroud segment;

a coating disposed on an outer surface of the tenon;

a bushing at least partially disposed within the opening in the inner shroud; segment, wherein the tenon is at least partially disposed within an opening defined by the bushing;

a bolt at least partially disposed within the opening in the bushing and threadably engaged with an inner surface of the tenon; and further comprising a welding joint coupling a washer to the bushing, wherein the bolt extends through an opening defined by the washer.

15. The repaired portion of the turbine of claim 14, wherein a thickness of the coating is from about 0.001" to about 0.020".

16. The repaired portion of the turbine of claim 15, wherein the coating comprises aluminum.

17. The repaired portion of the turbine of claim 16, wherein a clearance between the tenon and the bushing is from about 0.000" to about 0.012".

* * * * *